US006916162B2

(12) United States Patent
Schofield et al.

(10) Patent No.: US 6,916,162 B2
(45) Date of Patent: Jul. 12, 2005

(54) SCROLL COMPRESSOR

(75) Inventors: Nigel Paul Schofield, Horsham (GB); Michael Henry North, Reigate (GB); David John Goodwin, Crawley (GB)

(73) Assignee: The BOC Group plc, Windlesham (GB)

( * ) Notice: Subject to any disclaimer, the term of this patent is extended or adjusted under 35 U.S.C. 154(b) by 0 days.

(21) Appl. No.: 10/425,220

(22) Filed: Apr. 29, 2003

(65) Prior Publication Data

US 2004/0166007 A1 Aug. 26, 2004

(30) Foreign Application Priority Data

Feb. 25, 2003 (GB) ..... 0304285

(51) Int. Cl.[7] ..... F04C 18/02
(52) U.S. Cl. ..... 418/55.2; 418/55.1
(58) Field of Search ..... 418/55.2, 55.1

(56) References Cited

U.S. PATENT DOCUMENTS

| | | | | |
|---|---|---|---|---|
| 4,382,754 A | | 5/1983 | Shaffer et al. | |
| 4,475,875 A | * | 10/1984 | Sugimoto et al. | 418/55.1 |
| 4,579,512 A | | 4/1986 | Shiibayashi et al. | |
| 4,609,334 A | * | 9/1986 | Muir et al. | 418/55.2 |
| 4,726,100 A | * | 2/1988 | Etemad et al. | 29/888.022 |
| 5,632,610 A | * | 5/1997 | Tsubokawa et al. | 418/55.2 |
| 6,193,488 B1 | | 2/2001 | Kamiya et al. | |

FOREIGN PATENT DOCUMENTS

| | | | | |
|---|---|---|---|---|
| EP | 0 049 495 A1 | | 4/1982 | |
| EP | 0 769 623 B1 | | 9/2001 | |
| JP | 59012187 A | * | 1/1984 | F04C/18/02 |
| JP | 64-63682 A | | 3/1989 | |
| JP | 01130083 A | * | 5/1989 | F04C/18/02 |
| JP | 02086979 A | * | 3/1990 | F04C/18/02 |

OTHER PUBLICATIONS

Morozumi Naoya, et al., "Scroll Compressor," JP 1063682 A, Mar. 9, 1989, Toshiba Corp., PAJ abstract.

GB Search Report of Application No: GB 0304285.0; date of search: Sep. 17, 2003.

Patent Abstracts of Japan, Pub. No. 01063682, dated Mar. 9, 1989; Appln. No. 62220310, dated Sep. 4, 1987; entitled Scroll Compressor; Toshiba Corp., abstract.

Patent Abstracts of Japan, Pub. No. 09195959, dated Jul. 29, 1997; Appln. No. 08003341, dated Jan. 11, 1996; entitled Scroll Compressor; Toshiba Ave. Corp; abstract.

(Continued)

*Primary Examiner*—Theresa Trieu
(74) *Attorney, Agent, or Firm*—Ira Lee Zebrak

(57) ABSTRACT

A scroll compressor which comprises a scroll assembly comprising two scroll walls, and a drive for causing a relative orbiting motion between the scroll walls for compressing fluid on two fluid flow paths between an inlet and an exhaust of the scroll assembly. A first fluid flow path is formed between a wall surfaces of the scroll walls and a second fluid flow path is formed between another facing wall surfaces of the scroll walls. A first ambient clearance $A_1$ is selected between the first two facing surfaces, and a second ambient clearance $A_2$ is selected between the second two facing surfaces, and where the first and the second ambient clearances are selected independently from each other. Independent selection permits each ambient clearance to be designed according to its own performance requirements, to take into account thermal expansion and manufacturing tolerances.

12 Claims, 10 Drawing Sheets

OTHER PUBLICATIONS

Patent Abstracts of Japan, Pub No. 02027183, dated Jan. 29, 1990; Appln. No. 63178362, dated Jul. 18, 1988; entitled Scroll Type Compressor, Toyota Autom Loom Works Ltd, abstract.

XP–001116126; Jens Gravesen & Christian Henriksen, The Geometry of the Scroll Compressor; SIAM Review, vol. 43, No. 1, pp. 113–126.

PCT Notification of Transmittal of the International Search Report and the Written Opinion of the International Searching Authority, or the Declaration mailed May 12, 2004 of International Application No. PCT/GB2004/000566; PCT International Search Report of International Application No. PCT/GB2004/000566, mailed May 12, 2004; and PCT Written Opinion of the International Searching Authority.

* cited by examiner

SCROLL COMPRESSOR

FIELD OF THE INVENTION

The present invention relates to a scroll compressor and particularly to a scroll wall of the compressor.

BACKGROUND OF THE INVENTION

FIG. 3 shows in accordance with the prior art a scroll compressor 10 know which comprises a fixed scroll 12 supported by a compressor casing 14 and an orbiting scroll 16 disposed opposite the fixed scroll supported by a crank shaft 18. The orbiting scroll and the fixed scroll wall form a scroll assembly 19. A motor or drive unit 20 is supplied for causing an orbiting movement of the orbiting scroll 16 in relation to the fixed scroll 12. The fixed scroll comprises a base plate 22 from which a scroll wall 24 extends generally orthogonally. The orbiting scroll 16 comprises a base plate 26 from which an orbiting scroll wall 28 extends generally orthogonally so as to co-operate with the fixed scroll wall 28 for compressing fluid between inlet 30 and an outlet 32 of the compressor 10 when the orbiting scroll 16 orbits about the fixed scroll 12.

In the arrangement shown, the orbiting scroll 16 is disposed towards the centre of the compressor 10 (i.e. towards the left of the fixed scroll in FIG. 3) and towards the moving parts of the compressor. This causes the orbiting scroll 16 to increase in temperature during use and causes thermal expansion of the orbiting scroll. The orbiting scroll 16 does not easily dissipate heat because generally it is positioned at a low pressure side of the compressor where conductive heat transfer to the fluid being pumped is limited and there is no access for ambient air. The fixed scroll 12 on the other hand is positioned with its rear face in the ambient air which is used to provide cooling. It will be understood therefore that the orbiting scroll 16 undergoes thermal expansion relative to the fixed scroll 12 between ambient temperature when the compressor is not in use (or when the components of the compressor are at the same temperature) and working temperatures when the pump is in use. A converse arrangement is possible, but not shown, in which the relative orientation of the fixed scroll and the orbiting scroll leads to the fixed scroll being heated and expanding relative to the orbiting scroll, although this arrangement is not currently preferred and will not be discussed further.

Thermal expansion of the orbiting scroll 16 translates into radial expansion of base plate 26. The radial expansion is generally dependent on the distance from the centre of the plate so that a radially outer portion of the plate expands more than a radially inner portion of the plate and accordingly, a radially outer portion of the orbiting scroll wall 28 expands more than a radially inner portion thereof. The inner section of the scroll wall expands about 10 to 50 (typically 30) microns whilst radially outer portions may expand by many times the inner clearance, about 100 to 500 microns (typically 200 to 300 microns for a 50° C. rise depending on the diameter of the scroll).

FIGS. 4 to 8 show cross-sections of the prior art scroll assembly, taken along line II in FIG. 3. Fluid enters the scroll arrangement at inlet 30 where orbiting movement of the orbiting scroll causes it to be compressed along two fluid flow paths and to be exhausted from outlet 32. The first path passes between a first two facing wall surfaces, that is, a radially outer wall surface 36 of the fixed scroll wall 28 and a radially inner wall surface 38 of the orbiting scroll wall 24. The second path extends between a second two facing surfaces, that is, a radially inner wall surface 40 of the fixed scroll wall 28 and a radially outer wall surface 42 of the orbiting scroll wall 24. Fluid on the first flow path is trapped in crescent-shaped fluid pockets 44 which are forced to shrink in size as they are caused to move inwardly by the motion of the orbiting scroll wall as can be seen from a comparison of the position of the single highlighted pocket 44 shown in FIGS. 4 to 8. Although a single pocket 44 is highlighted in FIGS. 4 to 8, it will be seen that the first fluid flow path contains as many pockets of trapped fluid being compressed as there are wraps of the scroll walls. In the same way, fluid on the second fluid flow path is trapped in crescent-shaped fluid pockets 46 and is forced inwardly by motion of the orbiting scroll 16.

During compression, each fluid pocket 44,46 extends for less than 3608 about the circumference of the scroll assembly. The first two wall surfaces 36,38 are separated by just enough space, or clearance, at the circumferential ends of the pockets 44 to resist the seepage of fluid. The second two facing wall surfaces 40,42 are also separated by a clearance at each circumferential end of pockets 46. These clearances are hereinafter referred to as running, or working, clearances. No sealant or lubricant is, therefore, required in the swept volume of the pump.

As will be seen from FIG. 4, fluid pockets on the first fluid path extend between clearances $C_1$ and fluid pockets on the second fluid path extend between clearances $C_2$. Clearances $C_1$ are substantially radially aligned and clearances $C_2$ are substantially radially aligned, however, clearances $C_1$ and $C_2$ are substantially diametrically opposed in the scroll assembly.

It is important to accurately maintain running clearances between the scroll walls since if the running clearance is too large seepage out of the pockets occurs leading to loss in efficiency. If the running clearance is too small, there is a possibility that the scroll walls collide. It is apparent that thermal expansion of one of the scroll walls affects the running clearances between the scroll walls between ambient and running conditions. This thermal expansion causes a problem which will be explained with reference to expansion of the orbiting scroll wall 28 relative to the fixed scroll wall 24. First, the radially outer wall surface 36 of the orbiting scroll wall 28 expands towards the radially inner wall surface 38 of the fixed scroll wall 24 thereby reducing clearance $C_1$ with the risk of collision between the scroll walls. Secondly, the radially inner wall surface 40 of the orbiting scroll wall 28 expands away from the radially outer wall surface 42 of the fixed scroll 24 thereby increasing the clearance $C_2$ therebetween and causing seepage. It is desirable therefore that when the pump is at ambient temperature (i.e. all components are at the same temperature), the scrolls do not collide with each other, but when the pump is at running temperature the clearances are neither too small that the scrolls collide nor too large that the pump does not achieve its vacuum performance.

FIG. 9 shows a representation of the relationship between running clearances $C_1$ and $C_2$ and clearances $A_1$ and $A_2$ (where '$A_1$' represents the clearance at ambient temperatures between the first two facing wall surfaces 36 and 38, and '$A_2$' represents the clearance at ambient temperatures between the second two facing wall surfaces 40 and 42). The relationship is plotted between the exhaust (radial centre) and the inlet (outer radial portion) of the scroll assembly. It will be seen that FIG. 9 does not show the actual spacing between the orbiting scroll wall 28 and the fixed scroll wall 24, which would be represented by cyclic curves forming pockets 44,46.

According to the prior art, sufficient ambient clearance $A_1$ is provided between the first two wall surfaces 36 and 38 to allow the orbiting scroll wall to expand without colliding with the fixed scroll wall and so that at working conditions a desired running clearance $C_1$ is achieved. According to the prior art, the ambient clearance $A_1$ is increased by angularly displacing the orbiting scroll wall relative to the fixed scroll wall. This angular displacement causes the radius of the orbiting scroll wall to be reduced relative to the fixed scroll wall at any given angle about the centre of the scroll assembly, even though the actual shape and pitch of both scroll walls remains the same. If ambient clearances $A_1$ are increased by this angular displacement, ambient clearance $A_2$ will be decreased. As shown in FIG. 9, clearance $A_1$ is the same as clearance $A_2$. At running temperatures, running clearance $C_1$ gradually reduces towards the inlet of the scroll assembly since thermal expansion increases depending on the radial distance from the centre of the scroll assembly. Conversely, running clearance $C_2$ gradually increases towards the inlet of the scroll assembly. As shown, the orbiting scroll wall 28 collides with the fixed scroll wall 24 towards the inlet of the scroll assembly. Further, compression of fluid on the first and the second fluid flow paths are different because $C_1$ is less than $C_2$ and therefore more seepage occurs in the second flow path thereby reducing efficiency.

A second prior art scroll compressor is described with reference to FIG. 10 which shows the same relationship between ambient clearances $A_1$ and $A_2$, and running clearances $C_1$ and $C_2$ as shown in FIG. 9. The second prior art scroll compressor to some extent reduces the extent of the problem highlighted above.

In the second depicted prior art scroll compressor, ambient clearance $A_1$ between a first two facing wall surfaces 50,52 gradually increases as the radial distance from the centre of the scroll assembly increases and ambient clearance $A_2$ between a second two facing wall surfaces 54,56 gradually decreases as the radial distance from the centre of the scroll assembly increases such that the rate of change of $A_1$ and $A_2$ are equal and respectively constant. The first two facing wall surfaces 50,52 are, respectively, a radially inner surface 50 of a fixed scroll wall 58 and a radially outer surface of an orbiting scroll wall 60. The second two facing wall surfaces 54,56 are, respectively, a radially inner surface 50 of the orbiting scroll wall 60 and a radially outer surface of the fixed scroll wall 58.

The above relationship between $A_1$ and $A_2$ is enabled by providing the orbiting scroll wall 60 with a spiral with a different pitch to that of the fixed scroll wall 58. In more detail, the orbiting scroll wall 60 has a spiral with reduced pitch in that its radius increases more slowly as it extends away from its centre than the increase in radius of the fixed scroll wall 58. Therefore, as the orbiting scroll wall 60 extends radially outwardly, $A_1$ gradually increases to compensate for the affect of thermal expansion which increases as distance from the centre (exhaust) increases. As will be seen in FIG. 10, $A_1$ is increased as compared to the prior art in FIG. 9. The second prior art scroll compressor allows for greater thermal expansion of the orbiting scroll wall without colliding with the fixed scroll wall at running temperatures, and without allowing $C_2$ to increase to allow significant seepage of gas between the second two facing wall surfaces 54,56. However, clearance $C_1$ and $C_2$ are not equal and therefore there will be some difference between fluid compression on the first fluid path and on the second fluid path. However, ambient clearance $A_2$, particularly towards the inlet, cannot be further increased without the risk of collision between the scroll walls.

It is desirable to provide an improved solution to the above problem.

SUMMARY OF THE INVENTION

The present invention provides a scroll compressor comprising: a scroll assembly comprising two scroll walls; and a drive for causing a relative orbiting motion between the scroll walls for compressing fluid on two fluid flow paths between an inlet and an exhaust of the scroll assembly, a first fluid flow path being formed between a first two facing wall surfaces of the scroll walls and a second fluid flow path being formed between a second two facing wall surfaces of the scroll walls; wherein a first ambient clearance is selected between the first two facing surfaces, and a second ambient clearance is selected between the second two facing surfaces, and wherein the first and the second ambient clearances are selected independently from each other.

The present invention also provides a scroll compressor comprising: a scroll assembly comprising two scroll walls; and a drive for causing a relative orbiting motion between the scroll walls for compressing fluid on two fluid flow paths between an inlet and an exhaust of the scroll assembly, a first fluid flow path being formed between a first two facing wall surfaces of the scroll walls and a second fluid flow path being formed between a second two facing wall surfaces of the scroll walls; wherein a first ambient clearance between the first two facing wall surfaces of the scroll walls increases as the radial distance from the exhaust increases and a second ambient clearance between the second two facing wall surfaces of the scroll walls decreases as the radial distance from the exhaust increases and the rate of change of the first ambient clearance is different to the rate of change of the second ambient clearance.

The present invention also provides a scroll compressor comprising: an orbiting scroll wall having a radially outer wall surface and a radially inner wall surface; and a fixed scroll wall having a radially inner wall surface and a radially outer wall surface, and the orbiting scroll wall is adapted to be driven by a drive to orbit relative to the fixed scroll wall; and wherein one or both of the orbiting scroll wall and the fixed scroll wall has at least one portion in which the wall thickness is tapered and at least one portion in which the wall surfaces thereof are parallel.

The present invention also provides a scroll compressor comprising: a scroll assembly comprising two scroll walls; and a drive for causing an orbiting motion of one of the scroll walls relative to the other of the scroll walls for compressing fluid between an inlet and an exhaust of the scroll assembly, the exhaust being at an axial centre of the scroll assembly and the inlet being at a radial outer portion of the scroll assembly; wherein one or both of the scroll walls are tapered so that the walls or walls have a greater radial thickness towards the exhaust and a smaller radial thickness towards the inlet.

Other aspects of the invention are defined in the accompanying claims.

BRIEF DESCRIPTION OF THE DRAWINGS

In order that the present invention may be well understood, two embodiments thereof, which are given by way of example only, will now be described with reference to the accompanying drawings, in which.

DETAILED DESCRIPTION OF THE INVENTION

Figure 11:
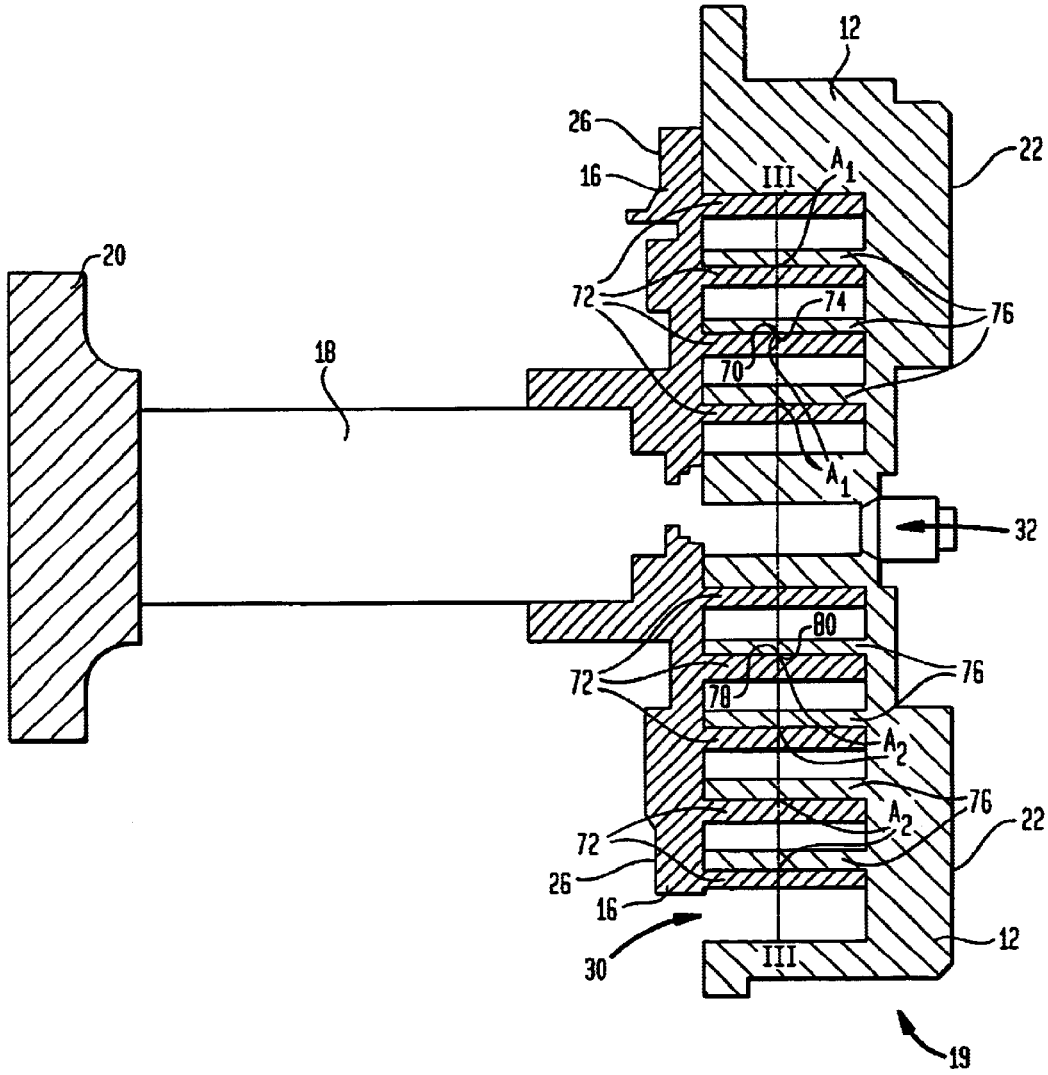
FIG. 11 is a side-section of a scroll assembly in accordance with the present invention.
Figure 12:
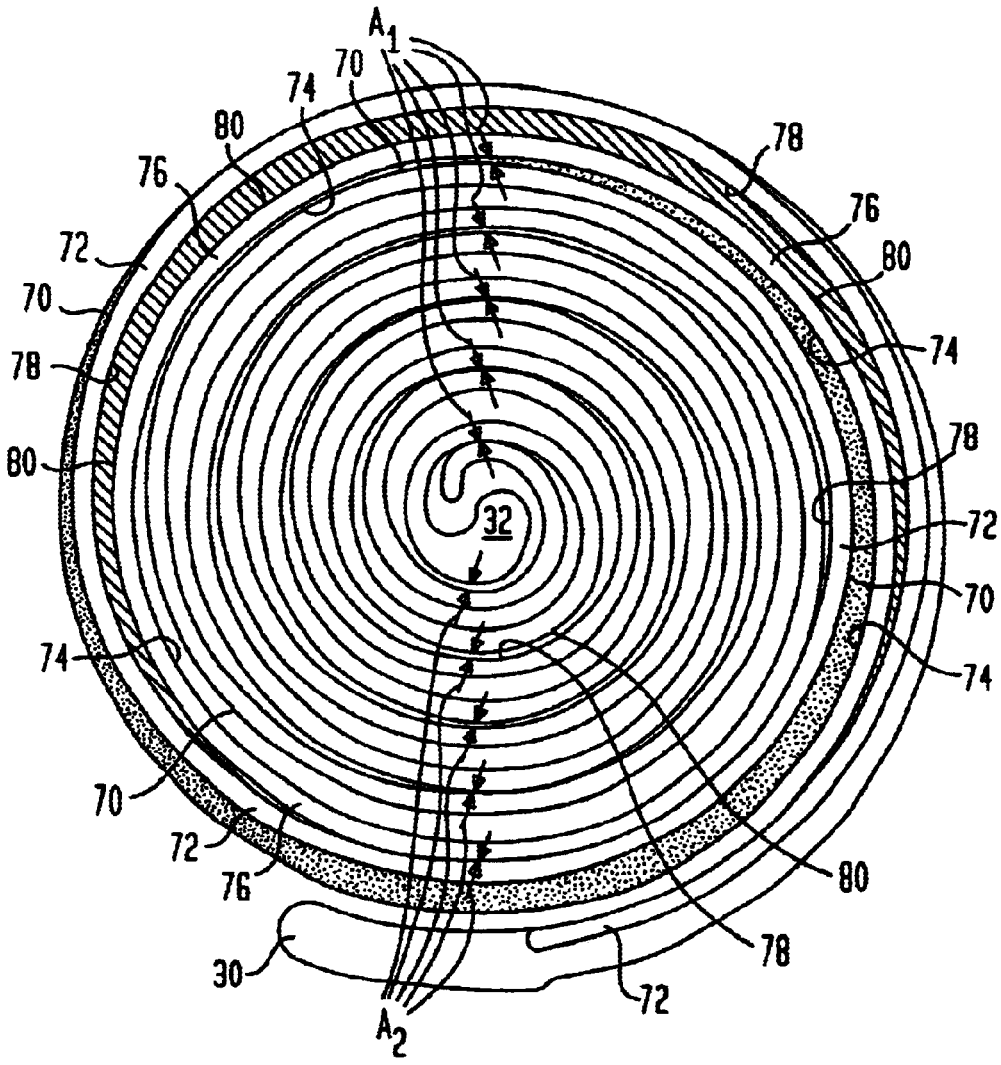
FIG. 12 is a section showing the scroll assembly in accordance with the present invention shown in FIG. 11.

The scroll compressors described hereinafter differ from the prior art described above in the shape of the scroll walls. Other aspects of the following scroll compressors are the same as the scroll compressor shown in FIG. 3 and the scroll assembly shown in FIGS. 4 to 8, and therefore will not be described in further detail. FIG. 11 shows the scroll assembly in accordance with the present invention depicted together with those other aspects of the prior art scroll compressor shown in FIG. 3. FIG. 12 is a sectional view of the scroll assembly in FIG. 11 showing further detail of the scroll walls in the same manner that the prior art scroll assemblies are shown in FIGS. 4–8.

FIG. 11 shows in accordance with the present invention, a scroll assembly 19 having an orbiting scroll 16 and a fixed scroll 12. Fixed scroll 12 comprises a base plate 22 from which a fixed scroll wall 76 extends generally orthogonally. Orbiting scroll 16 comprises a base plate 26 from which an orbiting scroll wall 72 extends generally orthogonally so as to cooperate with the fixed scroll wall 76 for compressing fluid between inlet 30 and an outlet 32. As shown in both FIGS. 11 and 12, fixed scroll wall 76 comprises a radially outer wall surface 80 and a radially inner wall surface 74. Similarly, orbiting scroll wall 72 comprises a radially outer wall surface 70 and a radially inner wall surface 78. Motor drive unit 20 is supplied for causing an orbiting movement of the orbiting scroll 16 in relation to the fixed scroll 12.

FIG. 12 is a cross-sectional view of the scroll assembly of the present invention, taken along line III in FIG. 11. Fluid enters the scroll assembly at inlet 30 where orbiting movement of the orbiting scroll 16 causes the fluid to be compressed along two fluid flow paths and to be exhausted from outlet 32. The first path extends between a first two facing wall surfaces, and more particularly between a radially outer wall surface 80 of the fixed scroll wall 76 and a radially inner wall surface 78 of the orbiting scroll wall 72, only a portion of which is cross-hatched in FIG. 12 for clarity of illustration. The second path extends between a second two facing wall surfaces, and more particularly between a radially inner wall surface 74 of the fixed scroll wall 76 and a radially outer wall surface 70 of the orbiting scroll wall 72, a portion of which is pebbled in FIG. 12.

An ambient clearance along the second fluid flow path is represented by $A_1$, and an ambient clearance along the first fluid flow path is represented by $A_2$ both of which are shown in FIGS. 11 and 12 in the same manner as shown in the prior art devices depicted in FIGS. 3–8. However, in accordance with the present invention, ambient clearance $A_1$ increases as a function of the radial distance from exhaust 32 and ambient clearance $A_2$ decreases as a function of the radial distance from exhaust 32.

Figure 1:
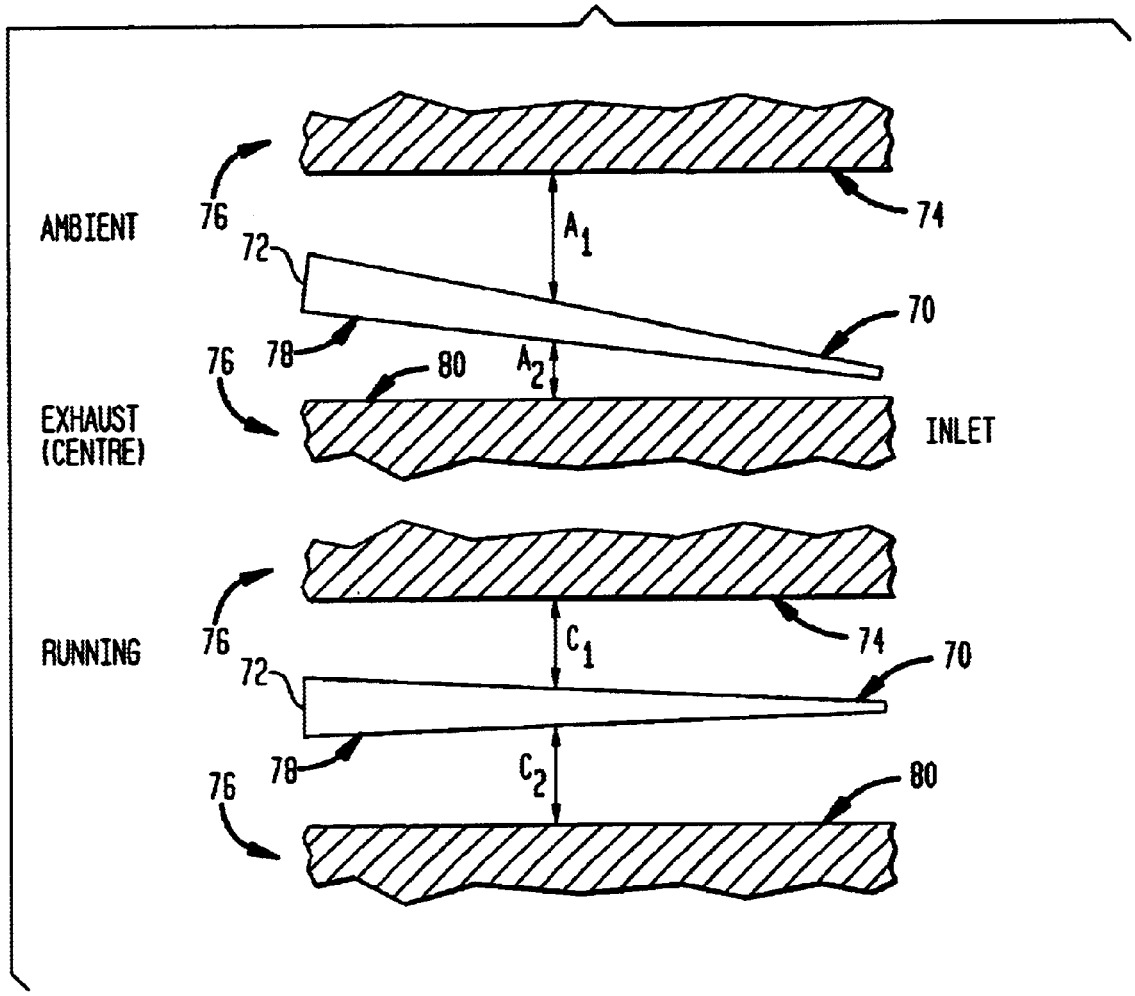
FIG. 1 is a representation of the scroll walls in accordance with a scroll compressor of a first embodiment of the present invention.

FIG. 1 shows a representation along the first and second fluid flow paths of the relationship between ambient clearances $A_1$ and $A_2$, and running clearances $C_1$ and $C_2$ for a scroll compressor of the first embodiment. The scroll compressor described with reference to FIG. 1 differs from the second prior art apparatus described above in that in the prior art the rate of change of ambient clearance $A_1$ is the same as the rate of change of the ambient clearance $A_2$ whereas in the first embodiment the rate of change $A_1$ is different to the rate of change of $A_2$ because the radially inner wall surface 78 and the radially outer wall surface 70 of the orbiting scroll wall 72 are not parallel as each wall surface is designed independently based on its performance requirements. In other words, ambient clearance $A_1$ and ambient clearance $A_2$ are selected independently from each other. As shown, the first ambient clearance increases uniformly (i.e. at a constant rate) as a function of the radial distance from the exhaust and the second ambient clearance decreases uniformly (i.e. at a constant rate) as a function of the radial distance from the exhaust. It should also be noted that the rate of change of the first ambient clearance is greater than the rate of change of the second ambient clearance.

In the scroll compressor described with reference to FIG. 1, as compared with the second prior art apparatus, the radial outer wall surface 70 of the orbiting scroll wall 72 is a spiral with a reduced pitch at ambient temperatures to allow for thermal expansion during use and to avoid collision with a radially inner wall surface 74 of a fixed scroll wall 76 at running temperatures. On the other hand, a radially inner wall surface 78 of the orbiting scroll wall 72 is a spiral with greater pitch than the pitch of the radially outer wall surface 70 to avoid collision with a radially outer wall surface 80 of the fixed scroll wall 76 at ambient temperatures during start-up of the compressor and to allow $C_1$ to be approximately equal to $C_2$ thus optimising compressor performance. The affect of designing the wall surfaces 70 and 78 independently is to provide an orbiting scroll wall 72 which is tapered towards the inlet so that the orbiting scroll wall has a greater radial thickness towards the exhaust and a lesser radial thickness towards the inlet.

The manufacture of a tapered orbiting scroll wall can be achieved by either gradually reducing the pitch of the spiral of one its wall surfaces, or gradually increasing the pitch of the spiral of the other one of its wall surfaces, or both of the above as shown in FIG. 1.

It is to be understood that the important aspect of the scroll compressor described with reference to FIG. 1 is the relationship between the first two facing wall surfaces 70,74 (i.e. ambient clearance $A_1$) and the relationship between the second two facing wall surfaces 78,80 (i.e. ambient clearance $A_2$). These relationships are affected as shown in FIG. 1 by altering the pitch of the spiral of wall surfaces 70 and 78. In a modification, the pitch of the spiral of wall surfaces 74 and/or 80 is altered to achieve a similar affect (i.e. the fixed scroll wall has a radial wall thickness which varies between the inlet and the exhaust). In a further modification, the spiral of one of the surfaces 70 and 74 and one of the surfaces 78 and 80 are altered to achieve a gain in performance (i.e. both the orbiting and the fixed scroll walls have respective radial wall thickness which vary between the exhaust and inlet).

A further embodiment of the present invention is designed taking into account local variations in temperature and differing manufacturing tolerances within the scroll wall assembly. To take account of these, the rate of change of the first and/or second ambient clearances are not constant from the exhaust to the inlet i.e. ambient clearances $A_1$ and/or $A_2$ change non-uniformly. Accordingly, the embodiment benefits from improved performance in comparison with the scroll compressor described with reference to FIG. 1.

As discussed above in relation to the prior art, thermal expansion of the orbiting scroll wall is greater at the outer radial portions thereof closer to the inlet 30 because expansion at outer radial portions is compound to the expansion at inner radial portions. Therefore, in the embodiment, the orbiting scroll wall has a tapered portion 86 closer to the inlet 30 and a parallel portion 88 closer to the exhaust. This means that the first ambient clearance $A_1$ changes at a different rate over the extent of the tapered portion to the rate of change of the first ambient clearance over the extent of the parallel portion. Likewise, the second ambient clearance $A_2$ changes at a different rate over the extent of the tapered portion to the rate of change of the second ambient clearance over the extent of the parallel portion. In the tapered portion, the radial wall thickness is gradually reduced towards the inlet whereas with the parallel portion the thickness is constant. The tapered portion 86 reduces the possibility of collisions at radially outer portions of the scroll assembly, whilst the parallel portion 88 increases performance where little thermal expansion takes place. The pressure during the inlet stages of the scroll assembly is less than that during the compression and exhaust stages, and therefore clearances between the scroll walls at the inlet stages can be larger than those during the compression and exhaust stages, because less seepage takes place at low pressures. Accordingly, a further advantage of the arrangement shown with reference to FIG. 2 is that less manufacturing accuracy is required at the outer radial portion of the scroll assembly thereby reducing costs.

Figure 2:
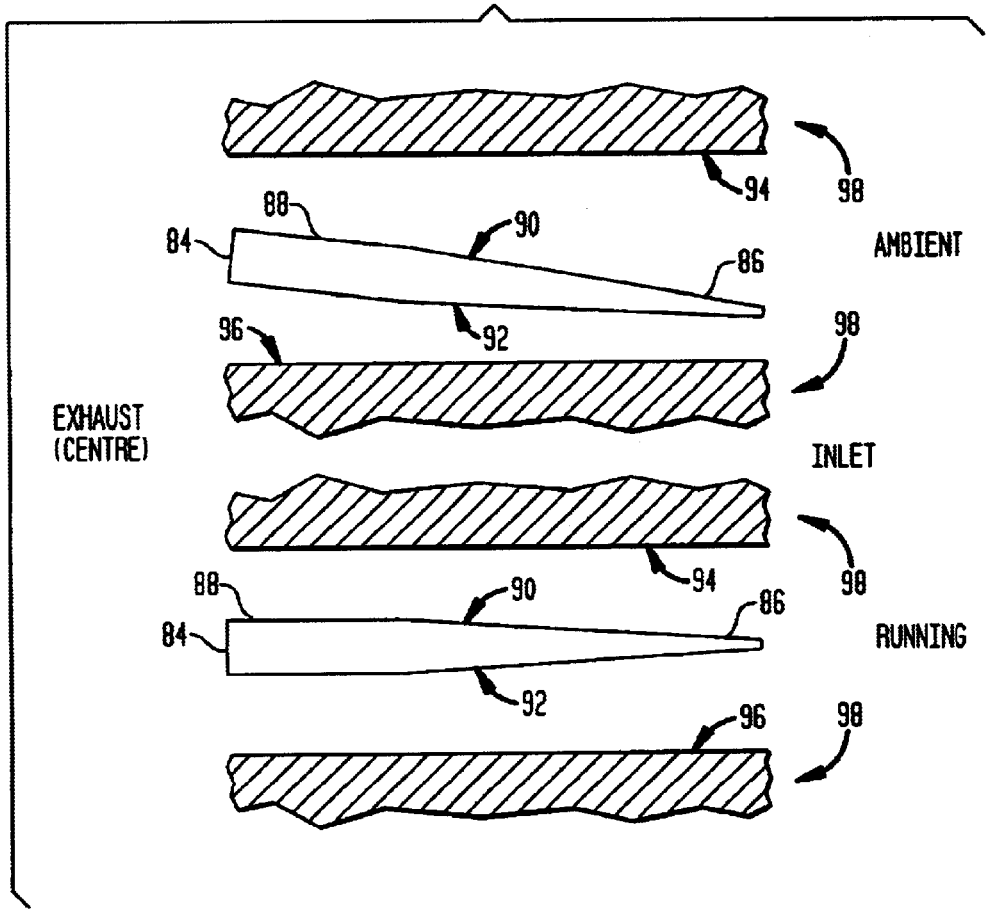
FIG. 2 is a representation of the scroll walls in accordance with a scroll compressor of a second embodiment of the present invention.

The manufacture of an orbiting scroll wall with a tapered portion can be achieved by either gradually reducing the pitch of the spiral of one its wall surfaces, or gradually increasing the pitch of the spiral of the other one of its wall surfaces, or both of the above as shown in FIG. 2. In addition to, or instead of, providing the orbiting scroll with a tapered portion it would be possible to provide the fixed scroll wall with a tapered portion in which one or both of the wall surfaces 94,96 of the fixed scroll wall 98 have a spiral with increasing/decreasing pitch.

Depending on the characteristics of the compressor, the fluid being compressed, acceptable manufacturing tolerances, it can be desirable to provide either or both of the fixed or orbiting scroll walls with more than one tapered portion and/or more than one parallel portion. In this regard, one or both of the scroll walls can have tapered and parallel portions in a similar way to that shown in FIG. 2, and a further tapered portion towards the exhaust of the scroll assembly (i.e. the wall thickness gradually increases between the parallel portion and the exhaust) in view of the reduced level of expansion which occurs at the centre of the scroll assembly. In this way, there is a tapered portion at a radially inner part of the scroll assembly with increasing radial wall thickness towards the exhaust where the scroll assembly expands least, a parallel portion at a radial intermediate part of the scroll assembly for increased efficiency, and a tapered portion at a radially outer part of the scroll assembly with decreasing thickness towards the inlet where more thermal expansion takes place, and where greater manufacturing tolerances are allowable. The rate of change of the wall thickness of the tapered portions can be the same or different.

A further modification of the scroll compressor described with reference to FIG. 2 comprises one or both of the scroll walls with a first tapered portion and a second tapered portion and the rate of change of the first and the second ambient clearances are different over the extent of the first tapered portion and over the extent of the second tapered portion. In other words, the radial thickness of the walls of at least one of the scroll walls varies at a different rate in the first tapered portion and in the second tapered portion. One example of this arrangement comprises a first tapered portion provided at a radially inner part of the scroll assembly with a wall thickness that decreases from the exhaust towards the inlet at a first rate. A second tapered portion is provided at an outer radial part of the scroll assembly with a wall thickness that decreases towards the inlet at a second rate different to the first rate. This arrangement seeks to increase efficiency towards the radial centre of the scroll assembly and allow for greater expansion towards the radially outer part of the assembly and/or where greater manufacturing tolerances are allowable. The same effect could be achieved by providing one scroll wall with a tapered portion towards the radial centre of the scroll assembly and a parallel portion towards the radially outer part of the assembly and the second scroll wall with a parallel portion towards the radial centre of the scroll assembly and a tapered portion towards the radially outer part of the assembly.

In summary, the embodiment provides a scroll compressor comprising a scroll assembly including two scroll walls at least one of which has a portion in which the radial wall thickness varies between an inlet and an outlet of the scroll assembly and a second portion in which the radial wall thickness is constant or varies at a different rate between the inlet and the outlet.

Reference has been made to ambient clearances $A_1$ and $A_2$, and running clearances $C_1$ and $C_2$ in the description of the embodiment and prior art. These clearances have been greatly exaggerated in the Figures since they are usually only of the order of 10 to 500 microns.

Figure 3:
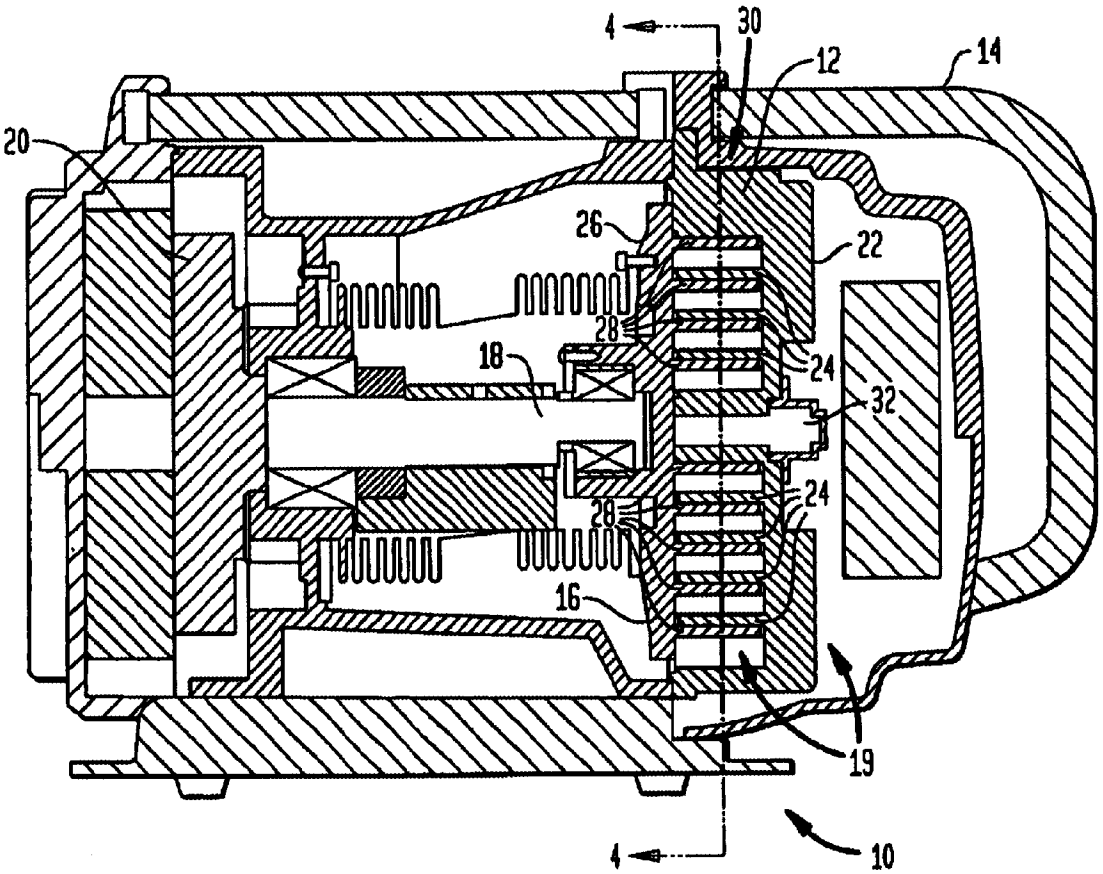
FIG. 3 (PRIOR ART)
FIG. 3 is a side-section of a scroll compressor in accordance with the prior art.
Figure 4:
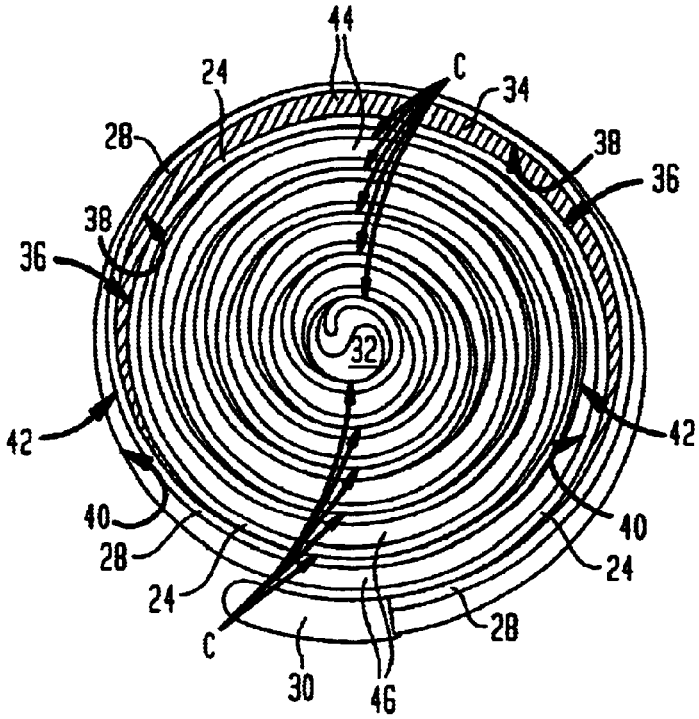
FIG. 4 (PRIOR ART)
FIGS. 4 to 8 are sections showing a scroll assembly of the prior art scroll compressor shown in FIG. 3.
Figure 5:
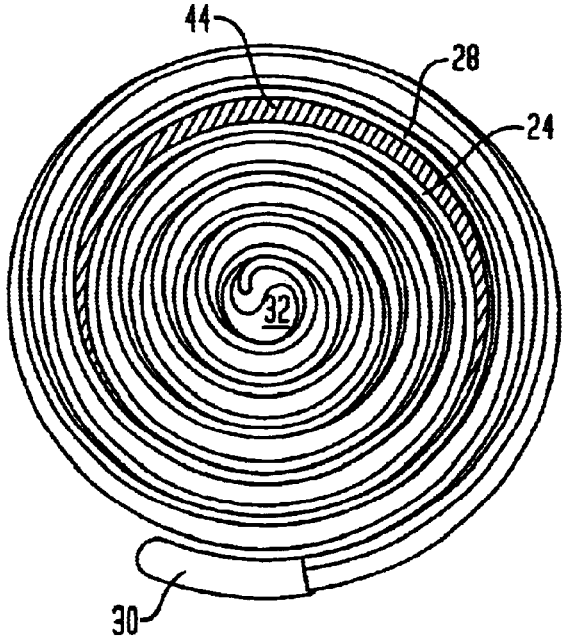
FIG. 5 (PRIOR ART)
Figure 6:
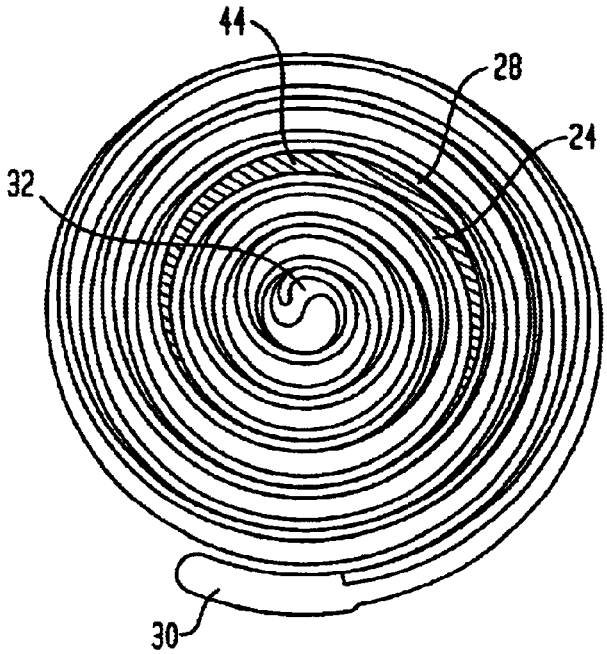
FIG. 6 (PRIOR ART)
Figure 7:
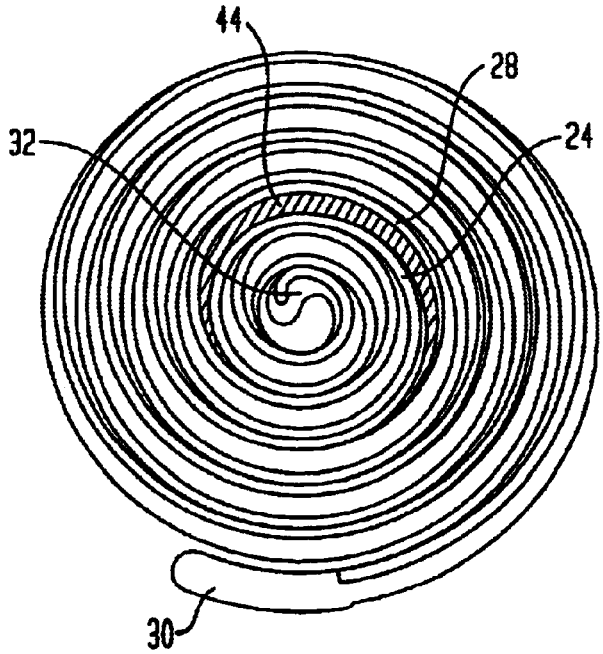
FIG. 7 (PRIOR ART)
Figure 8:
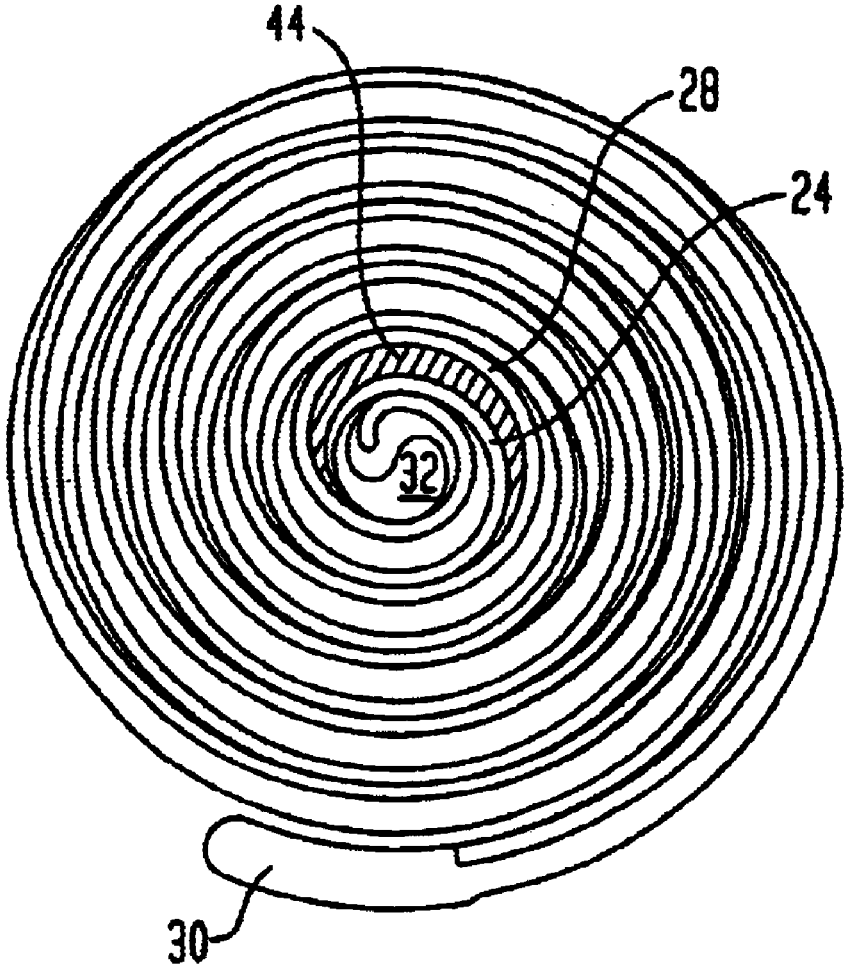
FIG. 8 (PRIOR ART)
Figure 9:
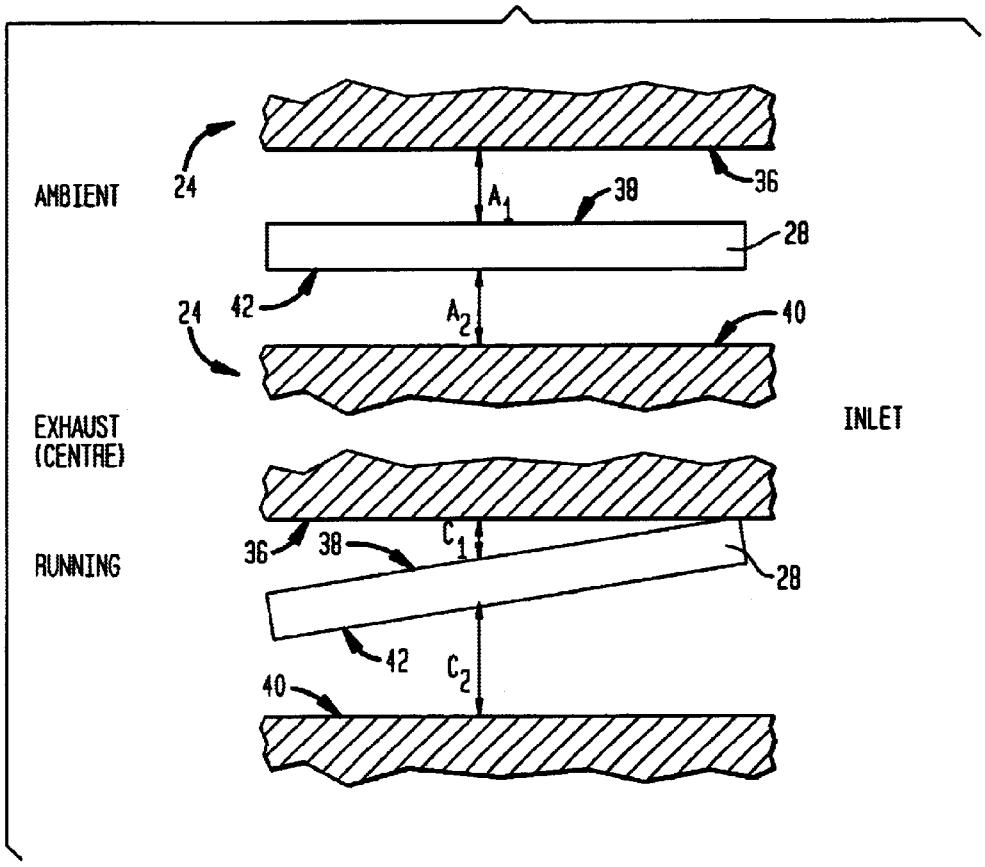
FIG. 9 (PRIOR ART)
FIG. 9 is a representation of the prior art scroll walls shown in FIGS. 4 to 8.
Figure 10:
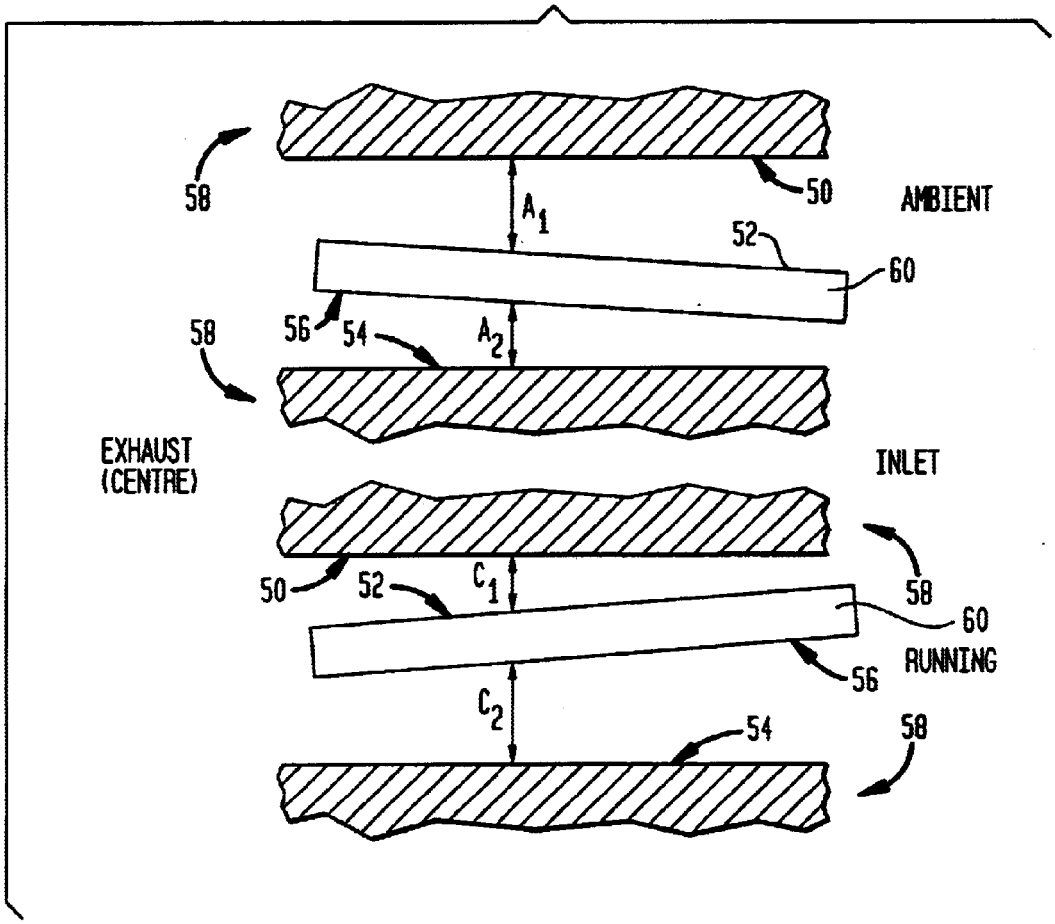
FIG. 10 (PRIOR ART)
FIG. 10 is a representation of a scroll assembly in accordance with a second prior art scroll compressor.

The invention has been described with reference to a scroll compressor comprising a scroll assembly as shown in FIG. 3. However, the present invention covers a scroll compressor comprising a scroll assembly in which a fixed scroll comprises a base plate having two scroll walls extending orthogonally from respective sides of the base plate and intermeshing with respective orbiting scroll walls of two orbiting scrolls.

While the present invention has been particularly shown and described with reference to the preferred embodiments thereof, it will be apparent to by those skilled in the art that various changes in form and details may be made therein without departing from the spirit and scope of the invention.

What is claimed is:

1. A scroll compressor comprising: a scroll assembly comprising an orbiting scroll wall and a fixed scroll wall each wall having a radially inner wall surface and a radially outer wall surface; a drive for causing a relative orbiting motion between the scroll walls for compressing fluid on two fluid flow paths between an inlet and an exhaust of the scroll assembly; a first fluid flow path being formed between the radially inner wall surface of the orbiting scroll wall and the radially outer wall surface of the fixed scroll wall and a second fluid flow path being formed between the radially inner wall surface of the fixed scroll wall and the radially outer wall surface of the orbiting scroll wall; wherein a first ambient clearance between the radially inner wall surface of the orbiting scroll wall and the radially outer wall surface of the fixed scroll wall decreases as the radial distance from the exhaust increases and a second ambient clearance between the radially inner wall surface of the fixed scroll wall and the radially outer wall surface of the orbiting scroll wall increases as the radial distance from the exhaust increases and the rate of change of the first ambient clearance is different to the rate of change of the second ambient clearance.

2. A scroll compressor as claimed in claim 1, wherein the first and the second ambient clearances are selected to allow for thermal expansion of one scroll wall relative to the other scroll wall during use.

3. A scroll compressor as claimed in claim 1, wherein the first ambient clearance increases uniformly as a function of the radial distance from the exhaust and the second ambient clearance decreases uniformly as a function of the radial distance from the exhaust.

4. A scroll compressor as claimed in claim 1, wherein the first ambient clearance increases non-uniformly as the radial distance from the exhaust increases and the second ambient clearance decreases non-uniformly as the radial distance from the exhaust increases.

5. A scroll compressor as claimed in claim 1, wherein one of the first ambient clearance and the second ambient clearance changes non-uniformly as the radial distance from the exhaust increases and the other of the first ambient clearance and the second ambient clearance changes uniformly as the radial distance from the exhaust increases.

6. A scroll compressor as claimed in claim 1, wherein the rate of change of the first ambient clearance is greater than the rate of change of the second ambient clearance.

7. A scroll compressor as claimed in claim 1, wherein the orbiting scroll wall is adapted to be driven by the drive to orbit relative to the fixed scroll wall.

8. A scroll compressor as claimed in claim 7, wherein the radially outer wall surface of the orbiting scroll wall is not parallel to the radially inner wall surface of the orbiting scroll wall.

9. A scroll compressor as claimed in claim 7, wherein the radially inner wall surface of the fixed scroll wall is not parallel to the radially outer wall surface of the fixed scroll wall.

10. A scroll compressor as claimed in claim 7, wherein one of the wall surfaces of the orbiting scroll wall is tapered relative to the other of the wall surfaces thereof and the orbiting scroll wall has a greater radial thickness towards the exhaust and a lesser radial thickness towards the inlet.

11. A scroll compressor as claimed in claim 7, wherein one of the wall surfaces of the fixed scroll wall is tapered relative to the other of the wall surfaces thereof and the fixed scroll wall has a greater radial thickness towards the exhaust and a lesser radial thickness towards the inlet.

12. A scroll compressor as claimed in claim 7, wherein the fixed scroll wall has at least one tapered portion and at least one portion in which the wall surfaces thereof are parallel.

* * * * *